US010968698B2

(12) United States Patent
Dück

(10) Patent No.: US 10,968,698 B2
(45) Date of Patent: Apr. 6, 2021

(54) DOOR, IN PARTICULAR A HIGH-SPEED DOOR

(71) Applicant: FRINOVA GMBH, Pansdorf (DE)

(72) Inventor: Wilhelm Dück, Lübeck (DE)

(73) Assignee: FRINOVA GMBH, Pansdorf (DE)

( * ) Notice: Subject to any disclaimer, the term of this patent is extended or adjusted under 35 U.S.C. 154(b) by 208 days.

(21) Appl. No.: 15/546,102

(22) PCT Filed: Jan. 28, 2015

(86) PCT No.: PCT/EP2015/051685
§ 371 (c)(1),
(2) Date: Jul. 25, 2017

(87) PCT Pub. No.: WO2016/119836
PCT Pub. Date: Aug. 4, 2016

(65) Prior Publication Data

US 2018/0016841 A1 Jan. 18, 2018

(51) Int. Cl.

| | |
|---|---|
| ***E06B 9/80*** | (2006.01) |
| ***E06B 9/13*** | (2006.01) |
| ***E05F 15/48*** | (2015.01) |
| ***E06B 9/58*** | (2006.01) |
| ***E06B 9/90*** | (2006.01) |

(52) U.S. Cl.
CPC ..... *E06B 9/80* (2013.01); *E05F 15/48* (2015.01); *E06B 9/13* (2013.01); *E06B 9/58* (2013.01); *E06B 9/90* (2013.01); *E06B 2009/807* (2013.01)

(58) Field of Classification Search
CPC ..... E06B 9/80; E06B 9/90; E06B 9/84; E06B 9/88; E06B 2009/802; E06B 2009/805; E06B 2009/807
See application file for complete search history.

(56) References Cited

U.S. PATENT DOCUMENTS

| | | | | |
|---|---|---|---|---|
| 2,492,816 A * | 12/1949 | Rosman | B66D 5/00 188/77 R |
| 4,294,302 A * | 10/1981 | Ricke, Sr. | E06B 9/17046 160/133 |
| 4,317,480 A * | 3/1982 | Phelps | E06B 9/40 160/23.1 |
| 4,398,585 A * | 8/1983 | Marlow | E06B 9/17076 160/23.1 |
| 6,625,936 B2 * | 9/2003 | Schmitz | E04F 10/0607 135/88.1 |
| 7,108,037 B1 * | 9/2006 | Ebeling | E04F 10/0666 160/298 |

(Continued)

FOREIGN PATENT DOCUMENTS

| | | |
|---|---|---|
| DE | 201 18 594 U1 | 5/2002 |
| DE | 20 2005 002391 U1 | 4/2005 |

(Continued)

*Primary Examiner* — Johnnie A. Shablack
*Assistant Examiner* — Shiref M Mekhaeil
(74) *Attorney, Agent, or Firm* — McGlew and Tuttle, P.C.

(57) ABSTRACT

A door includes a door leaf (1) with a vertical running direction and a drive (7) for opening and closing the door. A braking device (8) is provided, and this is configured such that the door leaf (1) cannot be moved in the closure direction solely by a weight force thereof, but only with the assistance of the drive (7).

15 Claims, 5 Drawing Sheets

(56) References Cited

U.S. PATENT DOCUMENTS

| | | | | |
|---|---|---|---|---|
| 2008/0127560 | A1* | 6/2008 | Harvey | E05F 15/686<br>49/199 |
| 2008/0134947 | A1* | 6/2008 | Huang | F27D 1/1858<br>110/173 R |
| 2010/0005723 | A1* | 1/2010 | Evans | E06L 39/74<br>49/322 |
| 2010/0013424 | A1* | 1/2010 | Nicholson | E06B 9/62<br>318/466 |
| 2012/0145335 | A1* | 6/2012 | Panseri | E05D 13/003<br>160/2 |
| 2013/0270101 | A1* | 10/2013 | Knoch | C10B 25/12<br>203/71 |
| 2014/0014279 | A1* | 1/2014 | Defenbaugh | E06L 39/68<br>160/168.1 P |
| 2017/0328126 | A1* | 11/2017 | Bonge, Jr. | E05F 15/0603 |

FOREIGN PATENT DOCUMENTS

| | | | | |
|---|---|---|---|---|
| EP | 0 816 624 | B1 | 5/2005 | |
| EP | 1 760 237 | A2 | 3/2007 | |
| EP | 1 874 673 | A1 | 10/2007 | |
| WO | 2007/006333 | A1 | 1/2007 | |
| WO | WO-2014199126 | A1 * | 12/2014 | E06B 5/16 |

* cited by examiner

DOOR, IN PARTICULAR A HIGH-SPEED DOOR

CROSS REFERENCE TO RELATED APPLICATIONS

This application is a United States National Phase Application of International Application PCT/EP2015/051685 filed Jan. 28, 2015, the entire contents of which are incorporated herein by reference.

FIELD OF THE INVENTION

The invention relates to a door, in particular to a high-speed door with a door leaf with a vertical running direction, with a drive for opening and closing the door.

BACKGROUND OF THE INVENTION

Doors with a vertical running direction of the door leaf are known in numerous embodiment variants. Thus there are lifting doors with regard to which the door leaf as a whole is moved upwards, those with regard to which the door leaf is moved upwards in a pivoting movement and those with regard to which the door leaf is moved upwards in segments. In particular, the invention relates to so-called high-speed doors with regard to which a flexible door leaf is wound up on a driven shaft for opening and is moved in the opposite direction for closure. Such high-speed doors are applied for example at the entry of refrigerated warehouses, in order to be able to keep the air exchange between the refrigerated warehouse and the surroundings as low as possible, also during the filling and emptying of warehouses. Such high-speed doors are known for example from EP 1 760 237 A2, EP 0 816 624 B1 or EP 1 874 673 A1.

Common to all lifting doors with a vertical running direction of the door leaf is the fact that they comprise a safeguard which prevents an unintended closure, in particular shutting of the door due to its intrinsic weight.

With regard to doors which are driven via a pull means, for example steel cables, chains or a toothed belt drive, the pull means is dimensioned such that a failure of this can be ruled out to a sufficient degree of certainty. However, a safeguard is effected via the drive. With modern motors controlled by frequency converter, the energy produced in generator operation on closure is fed back into the frequency converter, which can be problematic. With high-speed doors with regard to which a flexible door leaf is wound up onto a shaft, it is counted as belonging to the state of the art to provide centrifugal force safeguards which are activated on exceeding a predefined shaft speed and which stop the movement of the shaft and hence the closing movement of the door leaf.

SUMMARY OF THE INVENTION

Against this state of the art, it is an object of the invention to design a door, in particular a high-speed door, with a door leaf having a vertical running direction with simple means such that an unintended closure, in particular caused by the intrinsic weight of the door leaf, can be reliably ruled out in all operating situations. Moreover, the design should be such that the door where possible can open and close at a high speed.

The door according to the invention, which comprises a door leaf with a vertical running direction, is provided with a drive for opening and closing the door. According to the invention, the door comprises a braking device which is constantly effective (active) at least in the closure direction and which ensures that the door is braked at least in the closure direction, independently of its drive. Here, the braking device is advantageously designed such that the door leaf cannot be moved in the closure direction solely by way of its weight force, thus by way of the force caused by its intrinsic weight, but only with the assistance of the drive.

A basic concept of the solution according to the invention is to provide a braking device which ensures that the door leaf cannot move on its own accord, which is to say by its intrinsic weight, into the closure position, even in the case of a switched-off drive, failure of the drive, defect or breakage of the drive parts. The braking device thus produces a braking force which effectively prevents an unintended moving of the door leaf solely due to its weight force. Here, according to the invention, one can envisage this braking force constantly acting, which is to say not only given a standstill of the door leaf, but also on moving the door leaf in the direction of opening or closing. However, according to a further development of the invention, one can advantageously envisage the braking device counteracting a movement essentially in the closure direction, whereas no or at least a reduced braking force is active in the opening direction. By way of this, the drive can be relieved on opening the door, which has a positive effect on the opening speed.

According to an advantageous further development of the invention, the braking device can comprise a preferably mechanical brake which is effective between the door leaf and a lateral guide of the door leaf, preferably at both vertical sides of the door leaf Such a mechanical brake can be formed for example by way of a bracket which runs around a guide and which at its inner side comprises a brake lining, for example of felt and whose braking force can be adjusted by a adjusting screw which changes the circumference of the bracket or the pressing pressure of bracket halves to one another. Here, the brake should preferably be arranged at both sides, which is to say at both vertical sides of the door leaf, and specifically preferably close to the lower end or on the lower end of the door leaf. The arrangement at both sides effectively prevents a jamming and ensures that the braking forces are introduced uniformly onto both sides of the door leaf. This design according to the invention, with regard to which a mechanical brake is arranged between the door leaf and the door leaf guide, can be applied to any door which comprises a door leaf with a vertical running direction. With such a mechanical brake between the door leaf and the door, advantageously by way of a suitable mechanical design of the brake, one can succeed in the braking force in the closure direction always being greater than in the opening direction, which has the advantage that the braking device is at least partly relieved in the opening direction and thus does not counteract the drive operating in the opening direction. Such a mechanical arrangement can be achieved for example by way of applying a wedge-like component or an annular component which is wedge-like in cross section, said component reinforcing the pressing pressure of the brake in the closure direction and relieving it in the opposite direction.

With doors with regard to which the door leaf can be wound onto a shaft, as is typically the case with high-speed doors, with regard to which the shaft is connected to a drive, via which the door leaf can be wound up or wound off, according to an advantageous design of the invention a braking device which comprises a mechanical brake between the shaft and the stationary part of the door is provided. Such a brake is particularly advantageous since it is arranged in the region of the shaft, thus where, as a rule, sufficient free space is present, thus takes up no space in the region of the door and door leaf. This space where the shaft is usually arranged lies above the door opening and can neither be reached by vehicles moving in nor out and hence also lies outside the region which can be typically damaged by collision. The arrangement of the braking device in this region is therefore particularly advantageous for reasons of the operational safety.

The arrangement of a mechanical brake between the shaft and a stationary part of the door can also be advantageously applied with doors, with which the door leaf is moved via a pull means, as for example with rigid lifting doors or sectional doors. With regard to these doors, the design of the pull means is such that a failure of the pull means is inherently ruled out due to the design. Here, the pull means are either led over the shaft such that they are non-positively connected to this or however are wound on the shaft.

A brake disc which is arranged on the shaft in a rotationally fixed manner can advantageously be provided as a mechanical brake, wherein a brake caliper which is to be seen as being stationary with respect to the door is provided, said brake caliper comprising brake linings which are adjustably arranged therein and embracing the brake disc. Here, the brake linings are preferably constantly subjected to force towards the brake disc, wherein the magnitude of the force impingement can be adjusted. It is to be understood that the brake caliper can be advantageously designed in a floating manner with respect to the brake disc, or however a mechanism which distributes the pressing force uniformly onto both sides is provided, said pressing force acting on the brake disc preferably from both sides.

If the braking device comprises a brake arranged at the shaft side, then according to the present invention a hand brake is to be particularly preferably applied here, wherein the brake drum is then arranged on the shaft in a rotationally fixed manner and the brake belt which at least partly encircles the brake drum is essentially stationary. Such a belt brake is extremely robust and is also stable over the longer term with regard to the brake linings. Not only is the wear particularly low on account of the large brake surfaces, but the specific heating—the thermal energy converted via the brake—can be well dissipated over the comparatively large surface, without leading to damage due to local overheating.

The use of a belt brake moreover has the particular advantage that the braking effect can be different in the two rotation directions given a suitable design of the brake. For this, the brake belt is advantageously fastened in a stationary manner at one end and is movably fastened in a limited manner at the other end, wherein an adjusting device, with which the braking force can be adjusted, is advantageously provided at this end which is fastened in a limitedly movable manner.

According to a further formation of the invention, this belt brake is advantageously arranged such that it produces a greater braking force in the closure direction of the door leaf than in the opening direction. This is particularly advantageous since the drive motor then only needs to work against a lower braking force with the drive of the shaft in the opening direction, compared to the closure direction. The weight force which is to be mustered in the opening direction with the drive is then not additionally loaded by an increased braking force.

The adjustably fastened end of the brake belt is advantageously fastened to the stationary part of the door by a screw, wherein spring means are provided, said spring means being effective in the opening direction of the brake belt, thus ensure that the brake which is automatically assisted in its effect on moving the shaft in the closure direction is also relieved again on account of the spring force given the drive of the shaft in the opening direction. A helical spring which surrounds the adjusting screw or another suitable spring can be provided for this.

On use of a belt brake, a brake drum of metal is advantageously applied, whereas the brake belt at least in a region, in which it comes to bear on the drum, is provided with felt or a comparable lining which on the one hand can transmit the necessary braking effect and on the other hand has a high service life.

The invention is hereinafter explained in more detail by way of embodiment examples represented in the Figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
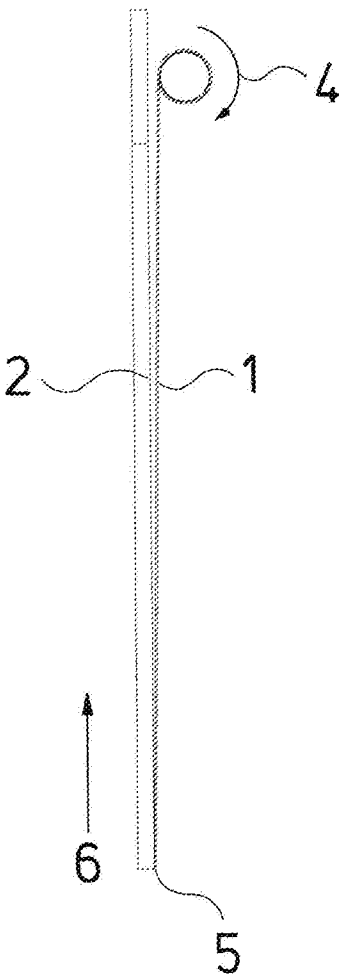
FIG. 2 is a schematic longitudinal sectional representation through the door according to FIG. 1.
Figure 1:
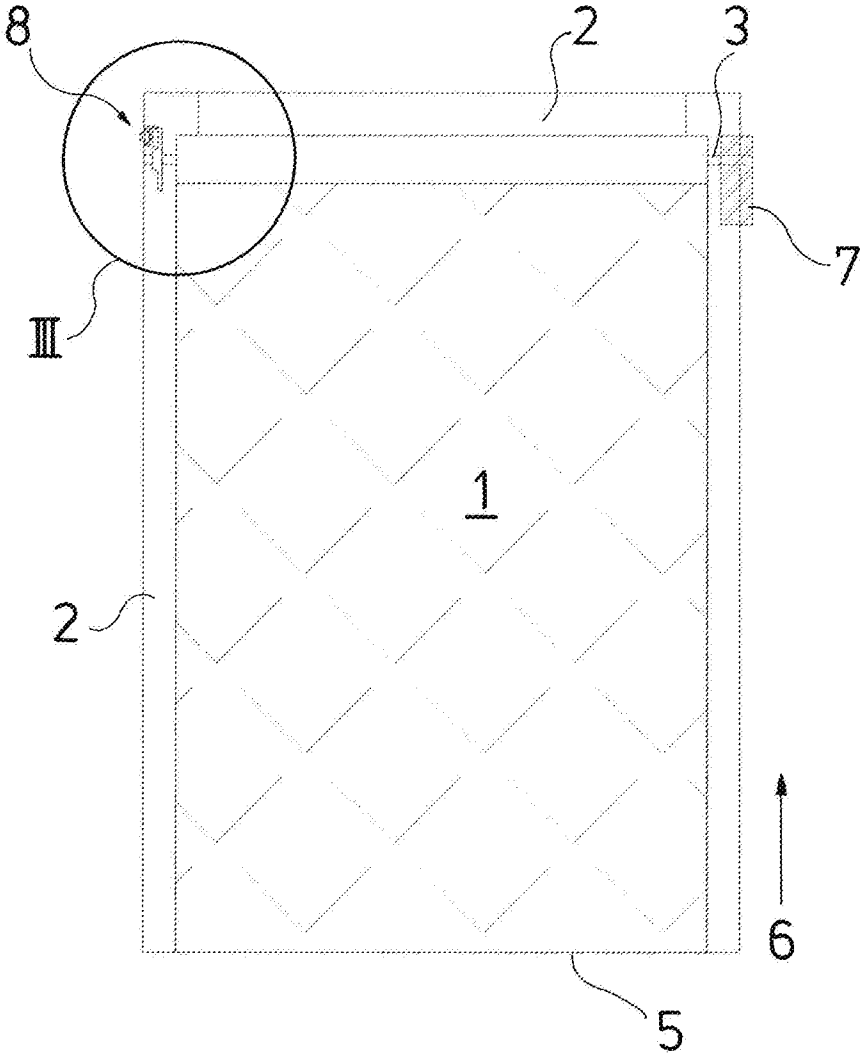
FIG. 1 is a greatly simplified schematic front view representation of a high-speed door.
Figure 3:
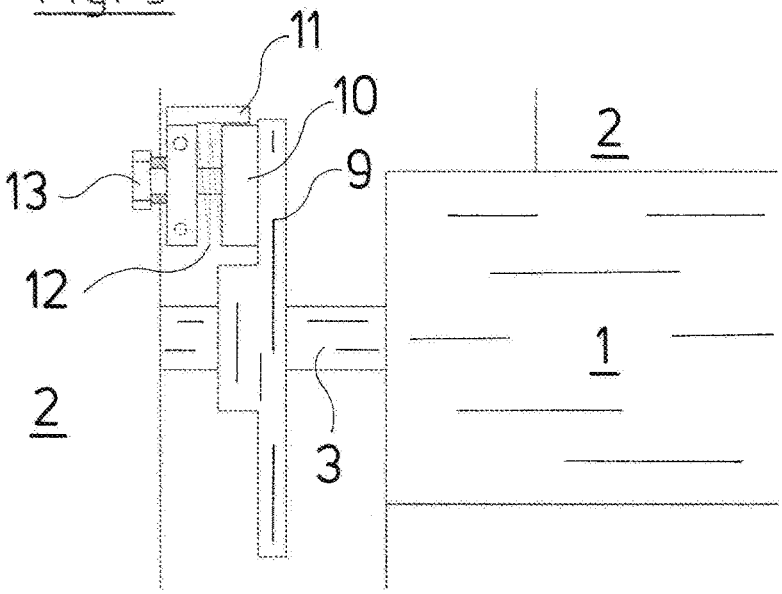
FIG. 3 is a detail III of FIG. 1 in an enlarged representation.

Referring to the drawings, the door represented by way of FIG. 1-3 is a high-speed door, with regard to which a door leaf 1 is vertically displaceable in front of or in a door frame 2. The door leaf consists of an elastically flexible material, typically of a multi-layered foil with gas-filled chambers and can be wound on a shaft 3 which is arranged close to the upper side of the door frame and which is designed as a winding shaft. One end of the door leaf 1 is fastened on this shaft 3, so that the door leaf is wound spirally onto the shaft 3 on rotating the shaft in the direction 4, by which means the other, free lower end 5 of the door leaf 1 is moved upwards along the frame 2 in the vertical direction 6, thus in the opening direction.

A drive motor 7 is provided for this, and this is fastened at the frame side and its drive shaft is drive-connected to the shaft 3 either directly or via a gear or is part of the shaft 3. The shaft 3 which is rotatably mounted at the frame side is connected at one end to the drive motor 7 and at its other end comprises a disc 9 which forms part of a braking device, with which it is ensured that the door leaf 1 remains in its position, thus in particular is not moved by its intrinsic weight in the closure direction counter to the direction 6, given a failure of the drive or a defect in the drive connection.

The disc brake 8 comprises a brake disc 9 which is connected to the shaft 3 in a rotationally fixed manner and on which a brake pad 10 bears, said brake pad being movably guided in the direction of the brake disc 9 as well as in the counter direction and specifically parallel to the rotation axis of the shaft 3, within a brake caliper 11 which is arranged at the door frame side 2. The brake pad 10 is subjected to force in the direction of the brake disc 9 via a tension spring 12. The clamping force can be adjusted by way of an adjusting screw 13 and determines the effective braking force of the disc brake 8.

In the design which is represented in the present highly schematic manner, the brake pad 10 bears on the brake disc 9 at one side. However, a brake caliper which in sections embraces the brake disc 9 at two sides and which comprises two brake pads which are moveable towards one another in order to increase the braking effect and to hold the bearings of the shaft 3 without axial forces and thus without braking forces can also be provided for increasing the braking effect.

The disc brake 8 which is described by way of FIG. 1-3 acts with the same braking force in the opening direction, thus when the free end 5 is moved upwards by way of winding the door leaf 1 on the shaft 3, as well as in the opposite direction, thus in the closure direction. The drive motor 7 must therefore overcome the braking force of the brake 8 in both directions, in order to move the door leaf 1. The brake 8 thereby ensures that the door leaf is always braked by the brake 8 and can only be moved with the help of the drive, independently of the position of the door leaf.

Figure 6:
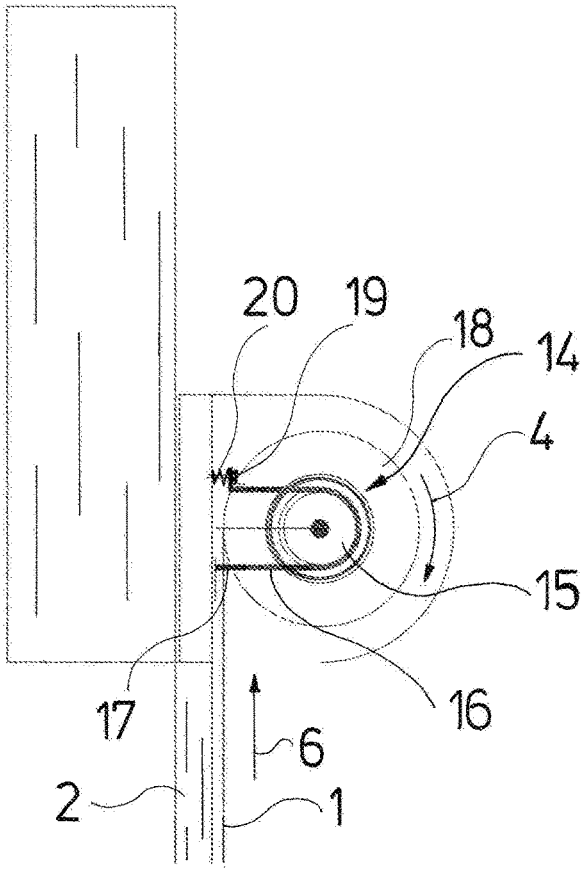
FIG. 6 is a detail VI in FIG. 5, in an enlarged representation.
Figure 4:
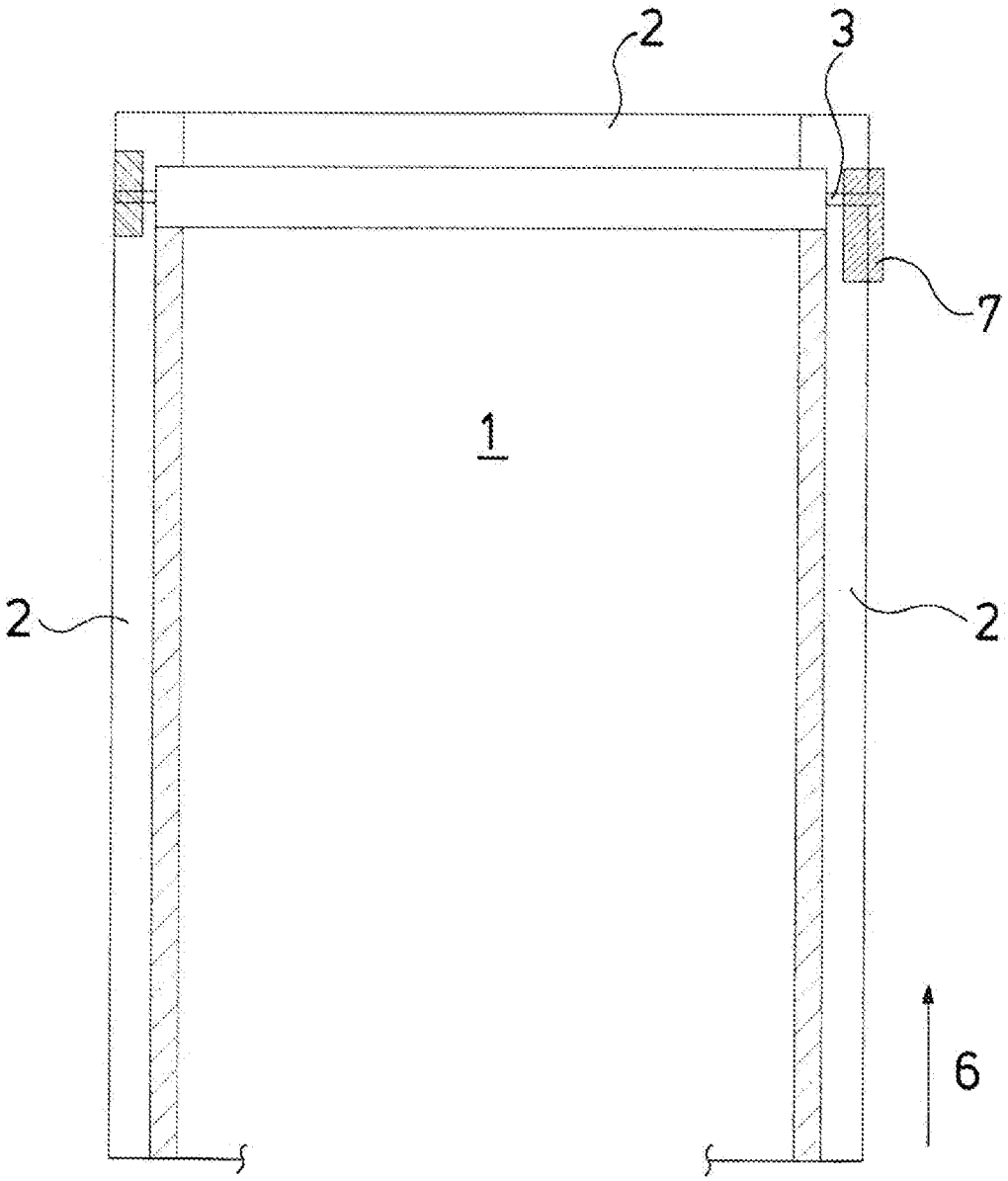
FIG. 4 is a greatly simplified schematic front view representation of an embodiment variant of the invention.
Figure 5:
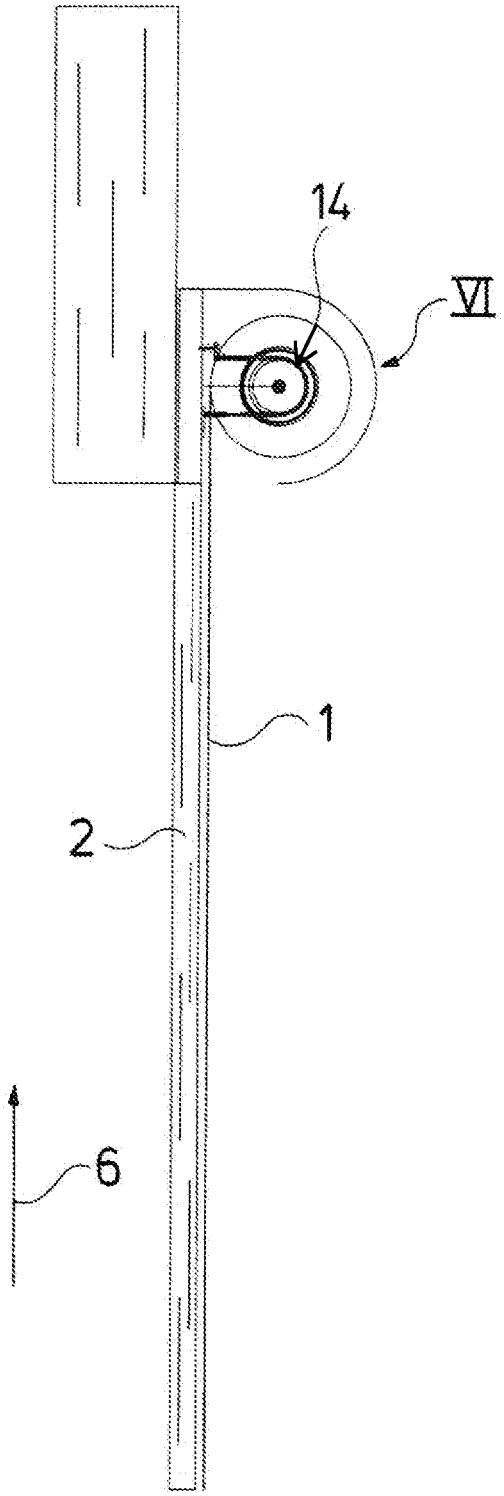
FIG. 5 is a schematic longitudinal sectional representation the embodiment variant according to FIG. 4.

The embodiment example represented by way of FIGS. 4-6 is likewise a high-speed door, with regard to which the door leaf 1 is vertically moved in front of a door frame 2 in order to open or close the door, and the door leaf 1 is wound on the shaft 3. In contrast to the previously described embodiment, it is not a disc brake 8 which is provided, but a belt brake 14 with a brake drum 15 which is connected to the shaft 3 in a rotationally fixed manner as well as with a brake belt 16 which encompasses the brake drum by more than 180 and which with one end 17 is fixedly connected to the door frame 2 and whose other end 18 is likewise connected to the door frame 2 in a limitedly movable manner via a adjusting screw 19. A tension spring 20 which surrounds the adjusting screw 19 is arranged between the end 18 and the door frame. The brake drum 15 consists of steel and the brake belt at its side facing the drum comprises a felt lining and otherwise consists of a flexible belt.

This belt brake 14 has the advantageous effect that it produces a greater braking force on moving the door leaf 1 in the closure direction opposite to the direction 6 when the shaft rotates counter to the direction 4, than in the opposite direction. Specifically, the brake belt 16 is then caught on account of the friction due to its wrapping around the brake drum 15 which rotates counter to the direction 4, by which means the movable end 18 is moved towards the door frame 2 counter to the force of the tension spring 20. Here, an automatic reinforcement of the braking effect is produced. If in contrast the door leaf 1 is moved upwards in the opposite direction, thus in the direction 6, then the belt brake is at least partly released. The tension spring 20 thereby releases the intimate interconnection between the brake belt 16 and the brake drum 15. The adjusting screw 19 however limits this path and ensures that an adequate braking force is always retained also with the upwards movement of the door leaf 1 in the direction 6, thus on rotating the shaft in the direction 4, in order to hold the door leaf 1 in its current position in the case of a failure of the drive and specifically independently of whether the door leaf 1 is completely wound on the shaft 3 or is largely wound off as is the case in the closure position of the door.

Figure 7:
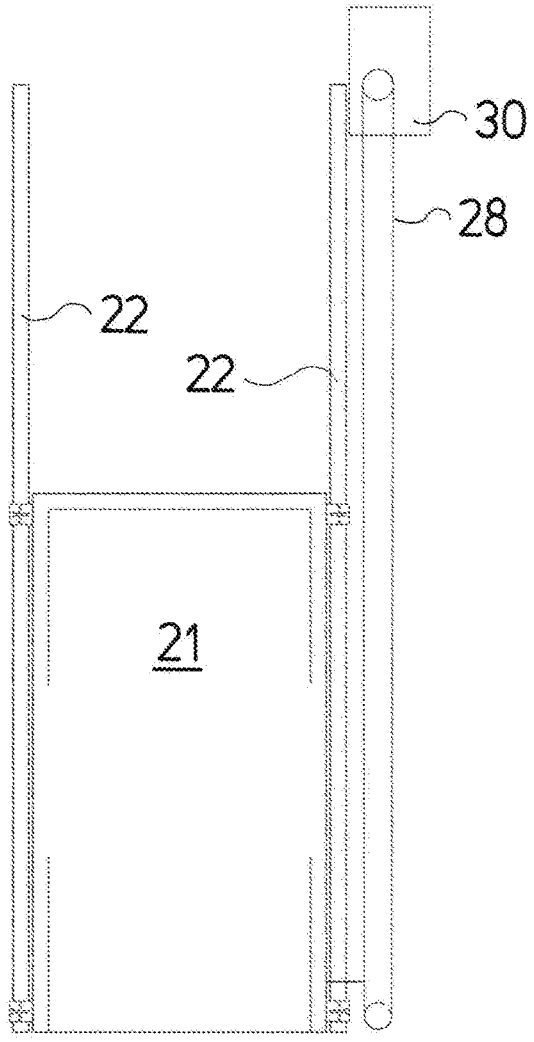
FIG. 7 is a greatly simplified schematic front view representation of a door with a rigid door leaf.
Figure 9:
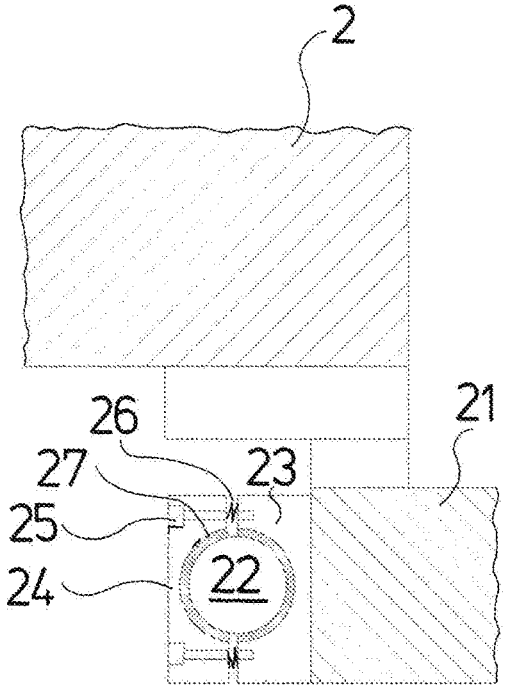
FIG. 9 is a detail IX in FIG. 8, in an enlarged representation.
Figure 8:
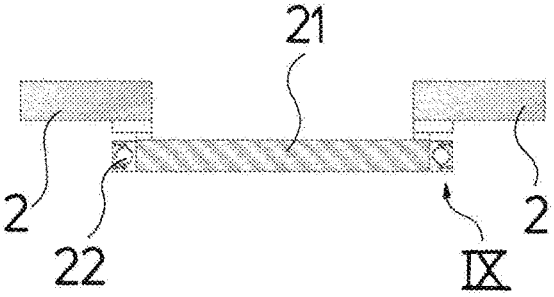
FIG. 8 is a cross sectional view through the door according to FIG. 7.

A rigid door leaf 21 which is vertically movable in front of the door frame which is not represented in detail is provided with the embodiment variant represented by way of FIGS. 7-9. Two guides 22, here in the form of guide tubes which are circular in cross section and between which the door leaf 1 is guided are provided at the frame side. Guide semi-shells 23 and 24 are provided for this, of which the semi-shells 23 are fastened laterally to the door leaf 21 and the semi-shells 24 are connected to the other guide semi-shell 23 via two screws 25 amid the inclusion of the respective guide tube 22. Springs 26 which press the semi-shells apart and which each surround the screws 25 are provided between the guide semi-shells 23 and 24 of a semi-shell pair. The semi-shells 23 and 24 at their inner sides are provided with a friction lining 27, here in the form of felt. The screws 25 are adjusted or set such that the guide semi-shell pairs 23, 24 hold the door leaf 21 on the guide tubes 22 in its vertical position, and specifically independently of the door position.

Here, a pull means drive is provided for the drive of the door leaf 21, said pull means drive being in the form of circulating chain 28 which comprises a driver (catch) 29 which couples the chain 28 in movement to the door leaf 21. The chain drive and thus the door leaf 21 are driven via a drive 30 which is arranged close at the upper end of a guide tube 22. The guide semi-shells 23 and 24 which are designed quasi as brake shoes ensure that the door leaf 21 is only moved when the drive 30 is active and otherwise remains in its position independently of the drive.

Figure 10:
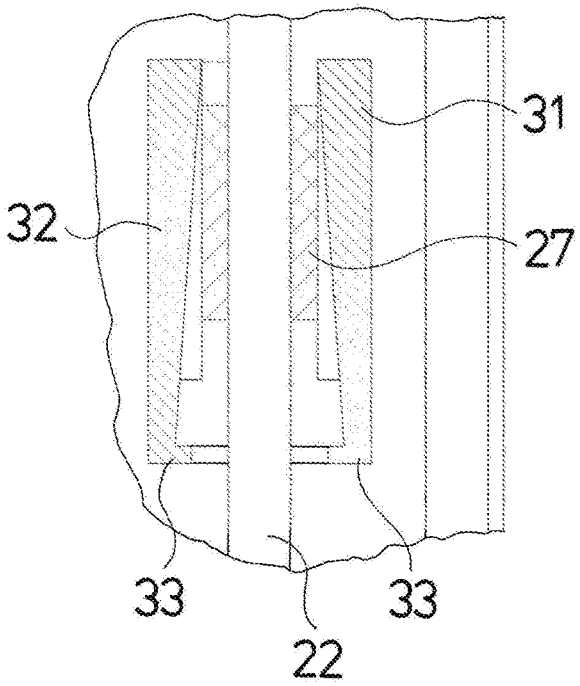
FIG. 10 is a longitudinal sectional view of an alternative embodiment of the brake as is represented in FIG. 9.

An alternative design of the guide semi-shells 23 and 24 is represented by way of FIG. 10, and this permits the braking force, thus the holding force of a guide shell pair 23, 24 around the guide tube 22 to be greater in the closure direction of the door 21 than in the opening direction. For this, the guide semi-shells 31 and 32 are designed conically at the inside, which is to say that the friction lining 27 to the bottom is here designed as a cylindrical ring, likewise of two semi-shells, but is movably mounted within a guide semi-shall pair 31, 32. Due to the conicity of the inner sides of the guide semi-shells 31 and 32, the friction lining 27 is pressed against the guide tube 23 given a downwards movement of the door leaf 21, thus given a movement in the closure direction, by which means the braking effect is reinforced. A greater braking effect is therefore achieved in the closure direction of the door leaf 21 than in the counter direction when the friction lining 27 is only held by a catch 33. Here too, a braking force relief is achieved in the case of an upwards movement in this manner.

While specific embodiments of the invention have been shown and described in detail to illustrate the application of the principles of the invention, it will be understood that the invention may be embodied otherwise without departing from such principles.

The invention claimed is:

1. A door comprising:

a door leaf with a vertical running direction and a closure direction;

a drive for opening and closing the door leaf;

a shaft connected to the drive and onto which the door leaf can be wound or which a pull means is led, via which the pull means the door leaf is movable; and a braking device which is continuously active at least in the closure direction, the braking device comprising a brake drum and a stationary belt brake continuously applying a frictional force to the brake drum, the brake drum being arranged on the shaft in a rotationally fixed manner, the stationary belt brake at least partly encompassing the drum, wherein the stationary belt brake is arranged such that a braking force is always applied in the closure direction of the door leaf and in an opening direction of the door, wherein the braking force applied in the closure direction of the door is greater than the braking force applied in the opening direction of the door.

2. The door according to claim 1, wherein the braking device is configured such that the door leaf cannot be moved in the closure direction solely by a weight force thereof, but with assistance of the drive.

3. The door according to claim 2, wherein the stationary belt brake is provided between the shaft and a door frame, the stationary belt brake comprising a belt brake portion engaging the brake drum, wherein the belt brake portion does not extend 360° about the brake drum.

4. The door according to claim 2, wherein the door leaf is movable via the pull means which pull means is led over the shaft which is connected to the drive and the stationary belt brake is provided between the shaft and a door frame.

5. The door according to claim 1, wherein the door leaf is windable up on the shaft and the stationary belt brake is provided between the shaft and a door frame, wherein one end of the stationary belt brake is located at a spaced location from another end of the stationary belt brake.

6. The door according to claim 1, wherein the door leaf is movable via the pull means which pull means is led over the shaft which is connected to the drive and the stationary belt brake is provided between the shaft and a door frame, wherein the brake drum comprises a belt brake engaging surface, the belt brake engaging surface defining only an outer circumferential peripheral portion of the brake drum.

7. The door according to claim 1, wherein the stationary belt brake is stationarily fastened at one end and is adjustably fastened at another end.

8. The door according to claim 7, wherein the adjustably fastened end of the stationary belt brake is adjustably fastened by way of a screw and a spring means is provided, effective in the opening direction of the stationary belt brake.

9. The door according to claim 7, wherein the adjustably fastened end of the stationary belt brake is adjustably fastened by way of a screw and a spring means is provided that is effective in the opening direction of the stationary belt brake.

10. A door comprising:

a door leaf with a vertical running direction and a closure direction;

a drive for opening and closing the door; and a braking device which is continuously active at least in the closure direction, the braking device comprising a belt brake, a spring, an adjusting screw and a brake drum, the brake drum being arranged on a shaft such that the brake drum rotates with the shaft, the shaft being connected to the drive, the belt brake at least partially surrounding the drum, wherein a braking force is continuously applied to the brake drum when the door is opening and when the door is closing via the belt brake.

11. The door according to claim 10, wherein the braking force is greater when the door leaf is moved in the closure direction than when the door leaf is moved in the opening direction, the belt brake comprising one belt brake end portion and another belt brake belt portion, the one belt brake end portion being located at a spaced location from the another belt brake belt portion.

12. The door according to claim 11, wherein one end of the belt brake is fixed to a door frame and another end of the belt brake is connected to the door frame in a movable manner via the adjusting screw, the spring surrounding at least a portion of the adjusting screw, the one end of the belt brake being located at a spaced location from the spring and the adjusting screw, wherein tension in the spring is adjustable via the adjusting screw.

13. The door according to claim 11, wherein the belt brake is stationarily fastened at one end and is adjustably fastened at another end, the brake drum comprising a brake belt contact area, wherein the brake belt contact area contacts the belt.

14. The door according to claim 13, wherein the adjustably fastened end of the belt brake is adjustably fastened by the adjustable screw.

15. The door according to claim 11, wherein the drive is actuated via a pull means led over the shaft, the pull means being connected to the drive and the spring being provided between the shaft and a door frame.

* * * * *